US005151275A

United States Patent [19]

Ito et al.

[11] Patent Number: 5,151,275

[45] Date of Patent: Sep. 29, 1992

[54] SEALING CONSTRUCTION FOR A PRESSURE CASTING MOLD

[75] Inventors: Takeshi Ito; Kazushige Murata, both of Iokonami, Japan

[73] Assignee: INAX Corporation, Tokoname, Japan

[21] Appl. No.: 704,199

[22] Filed: May 22, 1991

Related U.S. Application Data

[63] Continuation-in-part of Ser. No. 381,050, Jul. 17, 1989, Pat. No. 5,046,937.

[30] Foreign Application Priority Data

Jun. 28, 1990 [JP] Japan ..... 2-69283[U]

[51] Int. Cl.[5] ..... B28B 13/00

[52] U.S. Cl. ..... 425/84; 249/141; 264/86

[58] Field of Search ..... 249/134, 141, 113; 264/86, 87; 425/84, 85

[56] References Cited

U.S. PATENT DOCUMENTS

| | | | |
|---|---|---|---|
| 3,431,331 | 3/1969 | Pincus et al. | 425/84 |
| 4,853,087 | 8/1989 | Schlor et al. | 425/84 |
| 4,867,662 | 9/1989 | Shimahara et al. | 425/85 |
| 4,884,959 | 12/1989 | Ito et al. | 425/84 |
| 5,046,937 | 9/1991 | Ito et al. | 425/85 |

FOREIGN PATENT DOCUMENTS

| | | | |
|---|---|---|---|
| 58-208005 | 12/1983 | Japan . | |
| 62-181103 | 8/1987 | Japan | 425/85 |
| 8302251 | 7/1983 | World Int. Prop. O. | 425/85 |

*Primary Examiner*—Jay H. Woo
*Assistant Examiner*—Scott Bushey

[57] ABSTRACT

A casting mold for sanitary earthenware which has vertically dividable mold units having abutting surfaces with a porous portion of the same quality as a filter medium layer in the mold units and at a region between the porous portion and the exterior of the mold is disposed a sealing member, thereby preventing air leakage and slurry leakage from each mold unit.

3 Claims, 5 Drawing Sheets

SEALING CONSTRUCTION FOR A PRESSURE CASTING MOLD

This application is a continuation-in-part of copending application Ser. No. 07/381,050 filed Jul. 17, 1989, now patent Ser. No. 5,046,937 issued Sep. 10, 1991.

FIELD OF THE INVENTION

The present invention relates to a mold used in a pressure casting method which has vertically dividable mold unit to mold a sanitary earthenware or the like, and more particularly to a sealing construction used in a pressure casting mold which is capable of preventing the occurrence of deformation of the product at the abutting surfaces of the mold units.

PRIOR ART

A sludge casting method disclosed in the Japanese Patent Laid-Open Gazette No. Sho-208005 filed by the applicant has been well known. The molding equipment of the prior application, as shown in FIGS. 2 and 3, is so constructed that a molding apparatus 1 includes porous filter medium layers 3*a* and 3*b*, such as plaster, on the inner surfaces of vertically dividable pressure-proof containers 2*a* and 2*b*. Disposed in the filter medium layers 3*a* and 3*b* are drainages 4*a* and 4*b* at proper pitches, thus an upper mold unit 5*a* and a lower unit 5*b* are formed. Inside the filter medium layers 3*a* and 3*b* is formed an open space 6. At least one end of the drainages 4*a* and 4*b* are guided to the exteriors of pressure-proof containers 2*a* and 2*b* and connected to steam separators 12*a* and 12*b* to communicate with the atmospheric pressure or a negative pressure source. An overflow tank 7 is mounted to the upper mold 5*a* and communicates through the filter medium layer 3*a* with the mold space 6. A slurry supply-discharge pipe 8 is mounted to the lower mold unit 5*b* and communicates through the filter medium layer 3*a* with the mold space 6, the lower mold unit 5*b* being vertically movable along support poles 9*a* and 9*b*. A basic material transfer truck 10, which is horizontally movable toward or away from this mold and vertically movable below the lower mold unit 5*b* is provided.

The molding apparatus 1 disclosed in the Japanese Patent Laid-Open Gazette No. Sho 58-208005 of the prior application by the present applicant carries out casting in such a manner that slurry is supplied from the slurry supply-discharge pipe 8 to the mold space 6 until the slurry flows into the overflow tank 7. Compressed air is supplied into the overflow tank 7 to pressurize the slurry in the mold spaces 6 and the drainages 4*a* and 4*b* communicate with atmospheric pressure or the negative pressure source, thereby improving a deposition speed of slurry onto the filter medium layers 3*a* and 3*b* and the diffusion speed of water in the deposition. When the deposition on the inner surfaces of filter medium layers 3*a* and 3*b* reaches a predetermined thickness, the overflow tank 7 is pressurized at atmospheric pressure and surplus not deposited in the mold space 6 is discharged through the slurry supply-discharge pipe 8, whereby a product made of basic material 11 can be molded as shown in FIG. 3.

After the basic material 11 is molded, compressed air is sent to the steam separator 12*b* at the lower mold unit 5*b* side, the drainages 4*b* are back pressurized to exude out remaining water from the filter medium layer 3*b* to the border between the layer 3*b* and the basic material 11 so as to form a water film, so that the lower mold unit 5*b* is removed, in other words, the product made of the basic material 11 is held to the upper mold 5*a* by the vacuum in drainage 4*a*. Next, as shown in FIG. 3, the truck 10 is moved to below the product made of basic material 11 and a water film is formed at the border between the filter medium layer 3*a* of upper mold unit 5*a* and the basic material 11 in the same manner as in the removal of lower mold 5*b*, so that the basic material naturally drops onto the truck 10. Thereafter, the basic material is transported to the subsequent process, such as drying.

In the technique disclosed in the Japanese Patent Laid-Open Gazette No. Sho. 58-208005 of the prior application by the applicant, when pressure is applied to the slurry or back pressure is applied into the drainages 4*b* by compressed air, slurry leakage or air leakage has been generated between the abutting surfaces of upper and lower mold units 5*a* and 5*b*. The slurry leakage leads to the production of large burrs at the part of basic material 11 having a location corresponding to the abutting surfaces 13*a* and 13*b*. The air leakage causes an insufficient water film to be formed on the filter medium layer and the deposited slurry is stuck to the filter medium layer when removal is attempted so that the basic material 11 cannot be removed smoothly, thereby injuring the surface quality thereof and harmfully sticking it to the mold.

Therefore, the applicant, as shown in FIG. 4, has disposed sealing members 14*a* and 14*b* on the abutting surfaces 13*a* and 13*b* of the upper and lower mold units 5*a* and 5*b*, thereby preventing slurry leakage or air leakage.

However, when the sealing members 14*a* and 14*b* are so disposed, the water content in the slurry is insufficient to flow at the abutting surfaces 13*a* and 13*b*, so that the deposited slurry is smaller in thickness, thereby creating a defect in that a recess 15 is produced at the inner surface of basic material 11. Also, there is a defect in that the orientation of slurry particles at part of the basic material located in a position corresponding to the sealing members 14*a* and 14*b* is different from that at other portions. If such a recess 15 or portion of poor orientation exists, then the basic material 11 is softened in the baking process and lacks strength enough to bear its dead weight and keep its configuration. Also, the behavior of the basic material 11 following thermal expansion and contraction when baked is guided by the poor orientation of the slurry particles so as to be intended to swell the deposited slurry from the recess 15 to the exterior. Hence, as shown in FIG. 5, these actions are additive so as to form an acute-angular projection 17 at the surface of a product 16 after being baked, thereby creating a defect so that many inferior goods may be produced.

SUMMARY OF THE INVENTION

A pressure casting mold is provided wherein the abutting surfaces of vertically dividable mold units are provided with filter medium layers so as to form a molded open space, slurry is injected into the open space and deposited on the filter medium layers. Thereafter surplus slurry is discharged so as to mold a sanitary pottery or the like. The abutting surfaces of the mold units are made up of a porous portion of the same quality as the filter medium layer and in a region between the porous portion and the outside of the mold are disposed sealing members for preventing air leakage and slurry leakage.

Accordingly, for example, a region of a predetermined dimension across the molding surfaces of abutting surfaces of upper and lower molds, is formed of a porous portion of the same quality as the filter medium layers, and the sealing members are disposed outside the region. Accordingly, air leakage is not created at the abutting surfaces and also burrs are not created on the product. At the molding surface side of abutting surfaces there is provided a porous portion of the same quality as the filter medium layer, so that the water content in the slurry is sufficiently discharged therefrom. Moreover, since air fully communicates across this portion of the abutting during the back pressurization, a uniform water film can be formed on the entire molding surface, whereby there is no fear that poor removal of basic material from the mold will occur.

DESCRIPTION OF THE PREFERRED EMBODIMENTS

Figure 1:
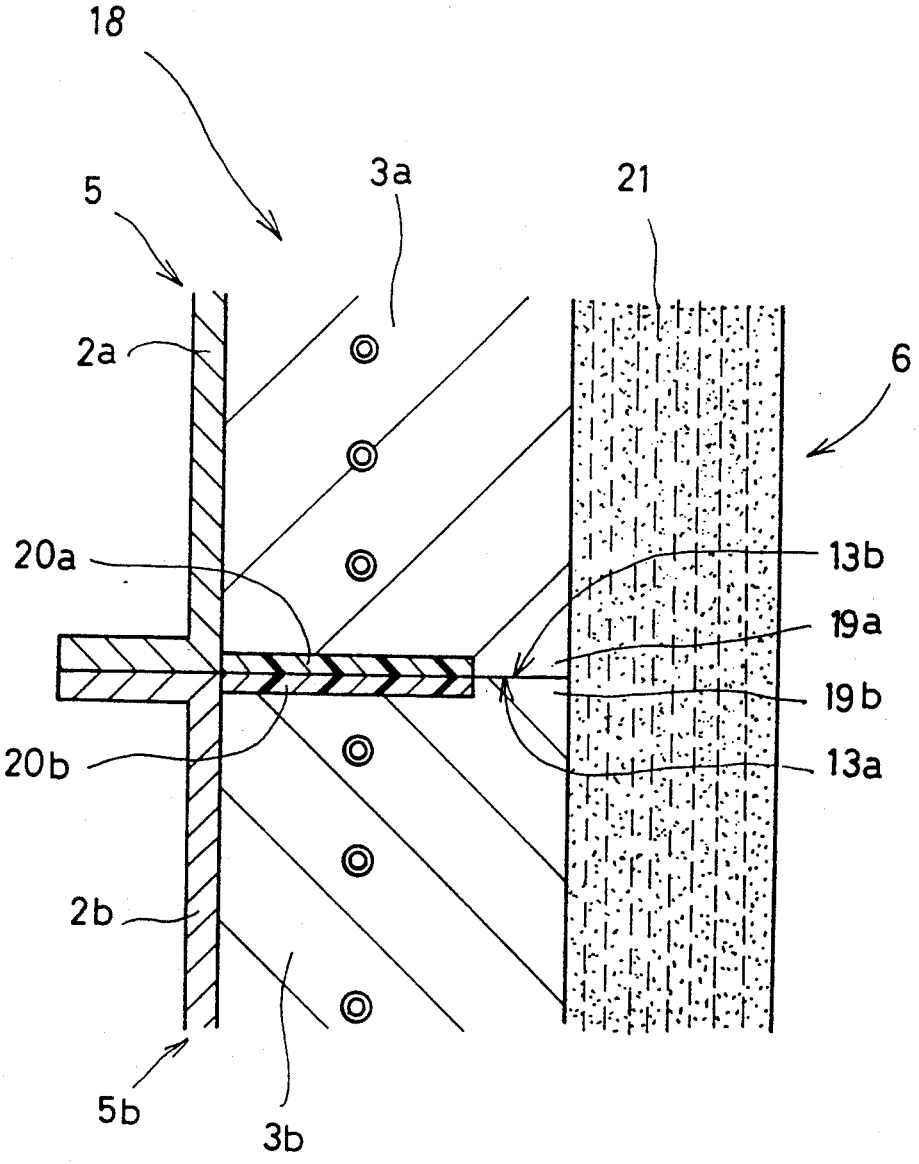
FIG. 1 is a partially longitudinally sectional view of an embodiment of a pressure casting mold of the present invention.
Figure 2:
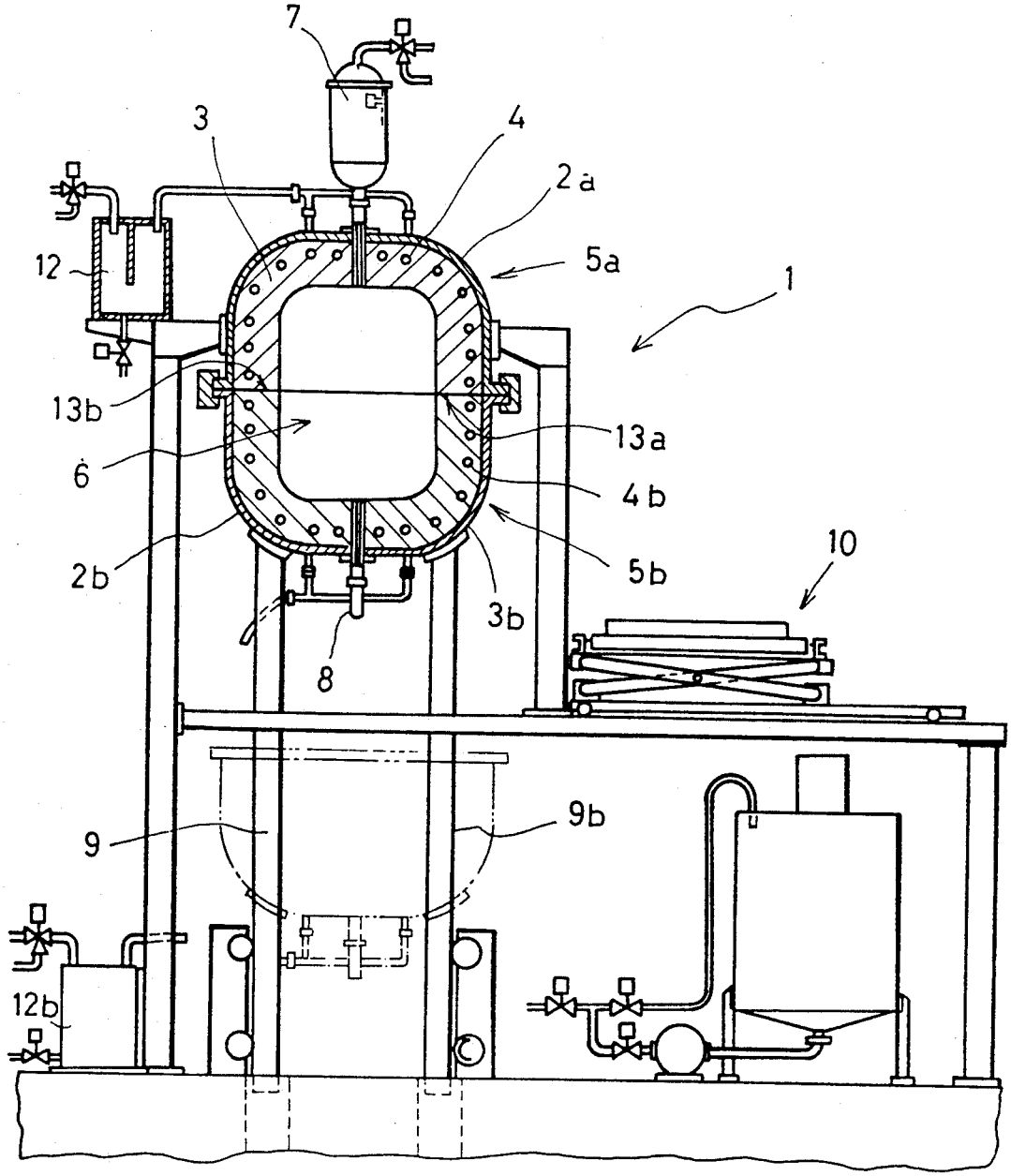
FIG. 2 PRIOR ART
FIG. 2 is a side view of the conventional pressure casting apparatus as a whole.
Figure 3:
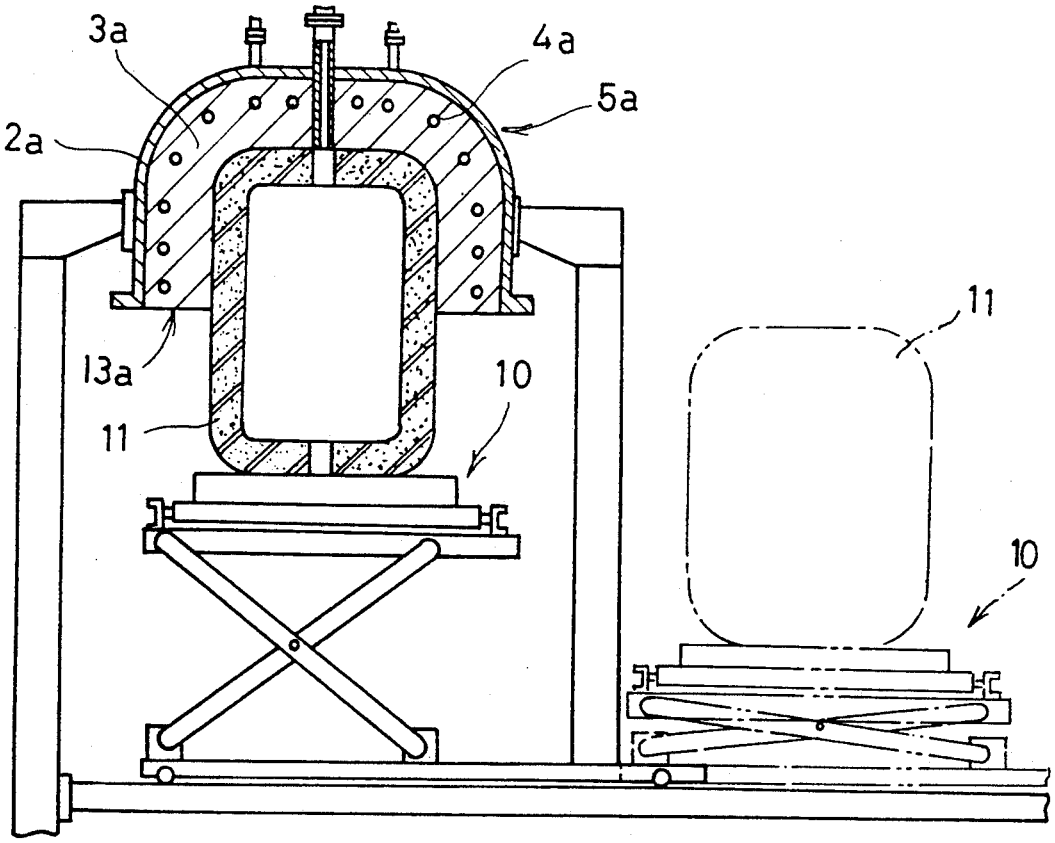
FIG. 3 PRIOR ART
FIG. 3 is a partially side view of a mold removal process in the prior art.
Figure 4:
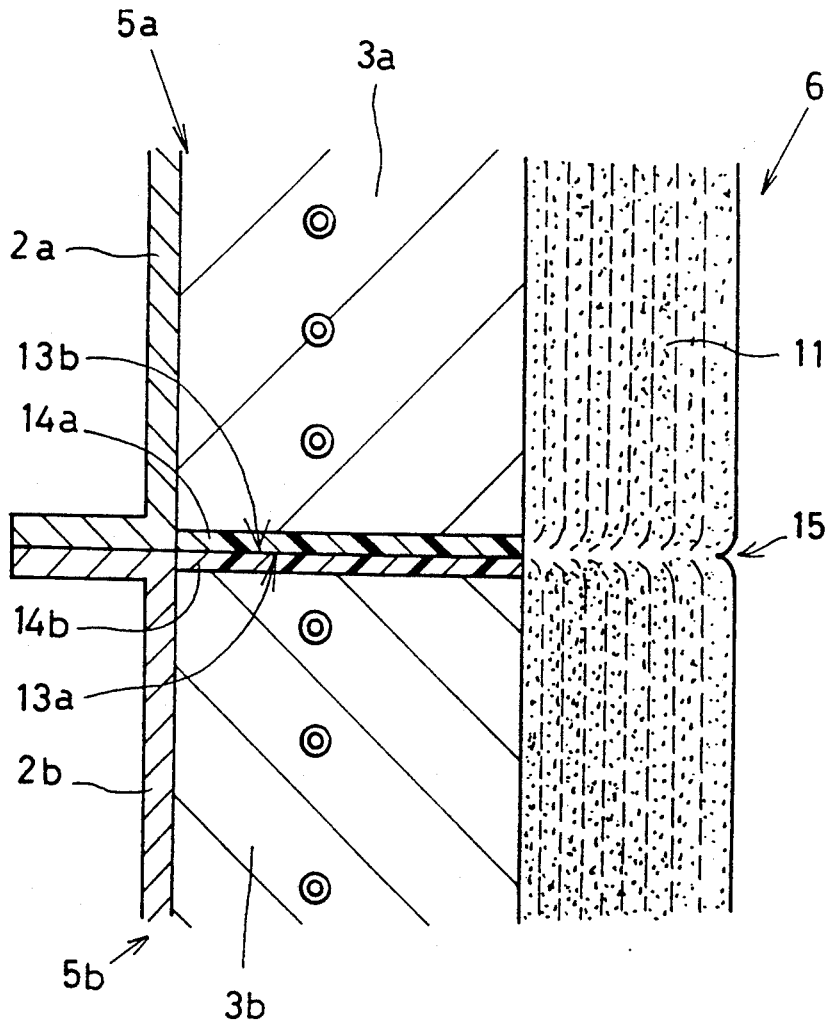
FIG. 4 PRIOR ART
FIG. 4 is a partially longitudinally sectional view showing the abutting surfaces of the mold in the prior art.
Figure 5:
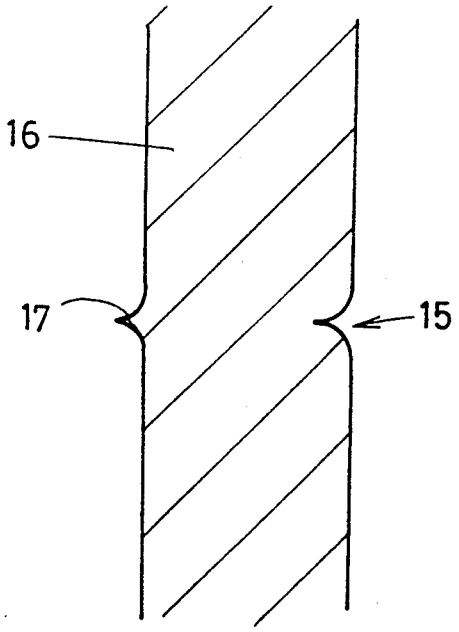
FIG. 5 PRIOR ART
FIG. 5 is a partially longitudinally sectional view of a product after being baked in the prior art.

Next, the construction of a pressure casting mold of the present invention will be described with reference to an embodiment shown in the drawings.

FIG. 1 is a partially longitudinally sectional view of abutting surfaces 13*a* and 13*b* of a pressure casting mold 18 of an embodiment of the present invention. As shown in FIG. 1, in this embodiment, regions of predetermined length at the abutting surfaces 13*a* and 13*b* of the upper mold unit 5*a* and lower mold unit 5*b* between the mold space 6 and the exterior of the mold are formed by porous portions 19*a* and 19*b* of the same quality as the filter medium layers 3*a* and 3*b*, and outside of porous portions 19*a* and 19*b* are disposed sealing members 20*a* and 20*b* for preventing air leakage.

The provision of sealing members 20*a* and 20*b* avoids leakage of slurry particles from the abutting surfaces when slurry is deposited to thereby prevent formation of a burr. During the back pressurization no air leaks from the abutting surfaces 13*a* and 13*b* take place and the water content stored in the filter medium layers 3*a* and 3*b* is exuded at the interface between the layers 3*a* and 3*b* at a basic material 21, thereby facilitating removal thereof from the mold. These operational effects are the same even when the sealing members 20*a* and 20*b* are adapted to be provided throughout the entire surfaces of abutting surfaces 13*a* and 13*b*. In brief, the sealing members 20*a* and 20*b* are not inevitably disposed as the conventional.

On the other hand, the porous portions 19*a* and 19*b* are provided on the abutting surfaces 13*a* and 13*b* at the molded space 6 side so that the water content in the slurry can uniformly and sufficiently be discharged from the entire molded surface including the abutting surfaces of filter medium layers 3*a* and 3*b*. Hence, the slurry can be deposited and grown on the molded surfaces of filter medium layers 3*a* and 3*b*. In other words, it is possible to make a uniform thickness of the entire basic material 21. Moreover, the orientation of slurry particles of the deposited slurry are arranged in one direction. Accordingly, when the basic material 21 is baked, there is no fear that it will be deformed following its thermal expansion and contraction. Therefore, the surface quality and configuration of a product are improved in accuracy and less faulty products are rejected, thereby providing an improvement in production.

The present invention is not limited to the above-mentioned embodiment, but can properly be modified in the configuration and kind of the pressure casting mold or the configuration and size of product.

As seen from the above, the pressure casting mold of the invention is provided at the abutting surfaces of the upper and lower molds with porous portions of the same quality as the filter medium layers and the sealing members are disposed at the outside thereof, whereby the water content in the slurry or air does not leak from the abutting surfaces and the creation of burrs and poor removal from the mold can be prevented. Also, the deposited slurry can be uniform in thickness and the orientation of deposited slurry can be arranged in one direction, thereby preventing the product from being deformed due to thermal expansion and contraction when baked. Therefore, it is possible to provide goods superior in surface quality or configuration accuracy and moreover the number of defective products is remarkably reduced so that an improvement in the yield of products is attained.

What is claimed is:

1. A mold used in pressure casting comprising:

a first mold unit, and a second mold unit contacting each other to form an exterior of the mold and forming an inner open space, each of said mold units including an inner porous filter medium layer, said first mold unit and said second mold unit having abutting surfaces, said abutting surfaces being made up of first portions and second portions, said first portions being made up of the same material as the inner porous filter medium layers, and extending part way from said inner space toward the exterior of the mold, and said second portions are made up of sealing members located between said porous filter medium layers of said mold units and extending between said first portions and the exterior of the mold.

2. A mold used in pressure casting as recited in claim 1 further comprising means for injecting slurry into said inner open space, whereby the slurry is deposited onto said porous filter medium layers.

3. A mold used in pressure casting as recited in claim 2 further comprising means for discharging excess slurry from said mold units.

* * * * *